United States Patent [19]

Weinhandl

[11] Patent Number: 4,657,488

[45] Date of Patent: Apr. 14, 1987

[54] TWO STAGE STEPPED PISTON AIR COMPRESSOR

[75] Inventor: Franz E. Weinhandl, Effretikon, Switzerland

[73] Assignee: Rockwell International Corporation, Pittsburgh, Pa.

[21] Appl. No.: 331,096

[22] Filed: Dec. 16, 1981

Related U.S. Application Data

[63] Continuation of Ser. No. 103,639, Dec. 14, 1979, abandoned.

[51] Int. Cl.[4] ..... F04B 3/00; F04B 25/02

[52] U.S. Cl. ..... 417/267; 417/268; 417/534

[58] Field of Search ..... 40/560, 534, 267, 268

[56] References Cited

U.S. PATENT DOCUMENTS 689,702 12/1901 Berg ..... 417/534 X 3,547,561 12/1970 Lavon ..... 417/560 X

FOREIGN PATENT DOCUMENTS 93014 11/1846 Fed. Rep. of Germany ..... 417/268

300659 4/1971 U.S.S.R. ..... 417/267

*Primary Examiner*—Carlton R. Croyle

*Assistant Examiner*—Ted Olds

[57] ABSTRACT

An air compressor with a cylinder (1) has a stepped piston (4) movably disposed therein which performs compression in both stroke directions to provide two-stage compression. Each compression stage is associated with at least one inlet and outlet valve (34, 36 or 35, 37), whereby one outlet opening (22) of a lower compression stage is connected with an inlet opening (20) of a higher compression stage. All valves (34–37) are disposed on the upper side of the compressor in the vicinity of the cylinder head (13; 30). The compressor has few individual parts and the valves are easily accessible for maintenance.

3 Claims, 2 Drawing Figures

TWO STAGE STEPPED PISTON AIR COMPRESSOR

This is a continuation of application Ser. No. 103,639, filed Dec. 14, 1979, now abandoned.

BACKGROUND OF THE INVENTION

The invention relates to an air compressor with a stepped piston movably disposed in a cylinder and which performs compression in both stroke directions, whereby each compression stage is associated with at least one inlet and one outlet valve, and whereby an outlet opening of a lower compression stage is connected with an inlet opening of a higher compression stage.

Air compressors with two compression stages are used to produce compressed air for the brake system in trucks. The compressor is flanged to the vehicle motor and is driven continuously. Because of the continuous drive, a pressure regulator opens a suction valve of the first stage when the intended pressure is reached. The dead volume of the second stage must be such that the compressor "runs dead" under the lowest operating pressure of the system. It is also possible to arrange a pressure regulator in the supply line of the compressor, whereby the regulator opens the supply line to the atmosphere when a prescribed high pressure is reached.

The provision of compression in both stroke directions assures smooth running and a compact construction. The latter is particularly important because of the limited available space in the engine compartment of a truck.

The use of this type of stepped piston compressor to produce compressed air for the brake system and for starting diesel truck engines is described in the magazine "Diesel And Gas Turbine Progress" of September, 1969.

The stages of a stepped piston compressor are necessarily disposed in different planes of the cylinder. In known two-stage compressors the valves of the first stage are disposed above or at the side of the upper end of the cylinder in the vicinity of the cylinder head. This enables the inlet and outlet valves to be designed independently of each other or, in other embodiments, to be combined with each other, i.e. the same valve can be provided with inlet and outlet functions. The separate inlet and outlet valves of the second stage are disposed in the lower portion of the cylinder.

These known compressors exhibit various disadvantages. They have a great number of individual parts and are therefore expensive. The different locations of the valves makes mounting difficult. Depending on the placement of the compressor on the vehicle motor, the side inlet and outlet valves of the second stage are either inaccessible or only accessible with a great deal of difficulty. To correct or check them the entire compressor must be removed. Maintenance and repair costs are therefore very high.

SUMMARY OF THE INVENTION

It is an object of this invention to eliminate these disadvantages and to provide a simple two-stage, stepped piston air compressor having fewer individual parts and a design which is more accessible for servicing. This object is achieved by arranging all valves in the upper portion of the compressor, near the cylinder head.

DETAILED DESCRIPTION OF THE PREFERRED EMBODIMENTS

Figure 1:
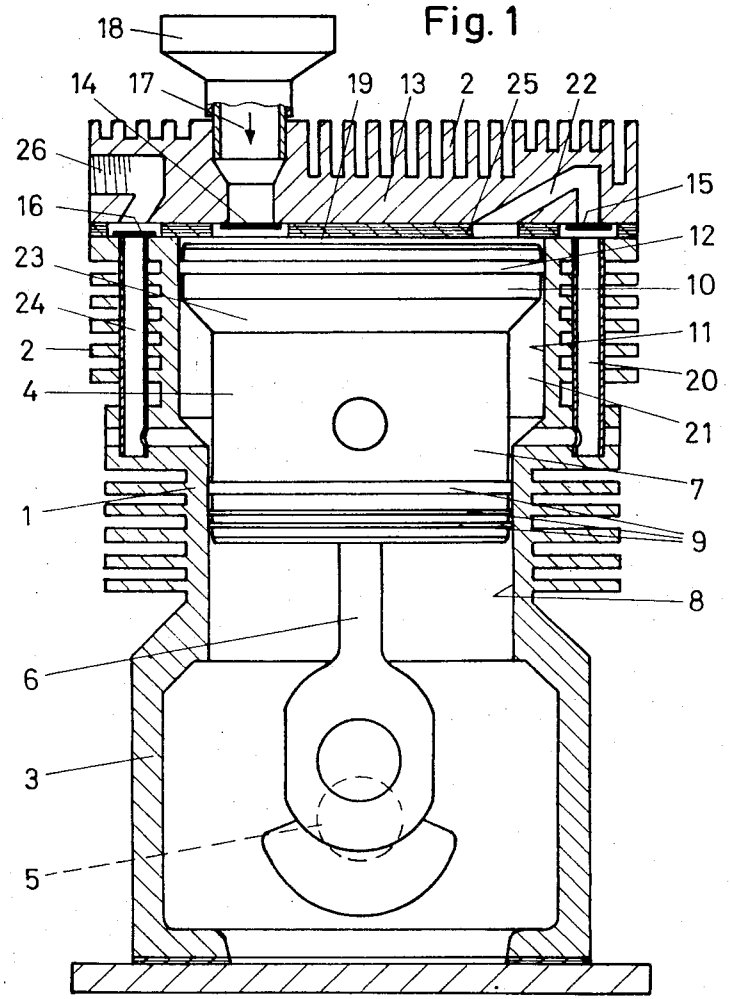

In an air cooled stepped piston compressor according to FIG. 1, a cylinder 1 provided with cooling fins 2 is formed in one piece with a drive shaft housing 3. A stepped piston 4 capable of reciprocating in cylinder 1 is driven by a drive shaft 5 and a piston rod 6.

A lower portion 7 of the piston 4 reciprocates in a lower bore section 8 of cylinder 1 and is sealed relative to the cylinder wall by piston rings 9. An upper, larger diameter portion 10 of piston 4 reciprocates in a correspondingly widened bore section 11 of cylinder 1 and is sealed relative to the cylinder wall by piston ring 12.

A cylinder head 13 provided with cooling fins 2 is screwed onto cylinder 1. Compressor valves 14 and 15 are disposed in this cylinder head 13. A further valve 16 is arranged on the upper surface of cylinder 1 directly beneath the cylinder head.

The valves 14–16 are non-return tongue valves, whose strokes are determined by the thickness of a seal 25 arranged between the cylinder head 13 and the cylinder 1. The thickness of the seal, i.e. the valve stroke, can be in the range of approximately 2 mm.

The compressor operates as follows:

During its downward stroke the piston 4 aspirates air through a filter 18 screwed into the cylinder head 13 and through the inlet valve 14 into a compression chamber 19 of the first stage. During the upward stroke the air is compressed and urged through the valve 15 and cooling pipe 20 into compression chamber 21 of the second stage.

The valve 15 simultaneously serves as an outlet valve from the first stage and an inlet valve to the second stage. This is made possible by directing the air through an angled channel 22 in the cylinder head 13. The volume of the channel 22 is incuded in the dead volume of the first compression chamber 19.

Similarly, the volume of cooling pipe 20 is included in the dead volume of the second compression stage. As is clear from FIG. 1, the second compression chamber comprises the two cooling pipes 20, 24 and the annular chamber 21 between the piston surface 23 and the expanded bore section 11 of the cylinder 1. The total dead volume is desirably about 5 to 10% because this enables a very intensive cooling of the air in the second stage and "dead running" during idling. The two cooling pipes 20, 24 are surrounded on all sides by the fins 2.

During its downward stroke the piston 4 further compresses the air to the final pressure and moves it through the cooling pipe 24 and the outlet valve 16 into the air exit opening 26, which is machined in cylinder head 13.

Figure 2:
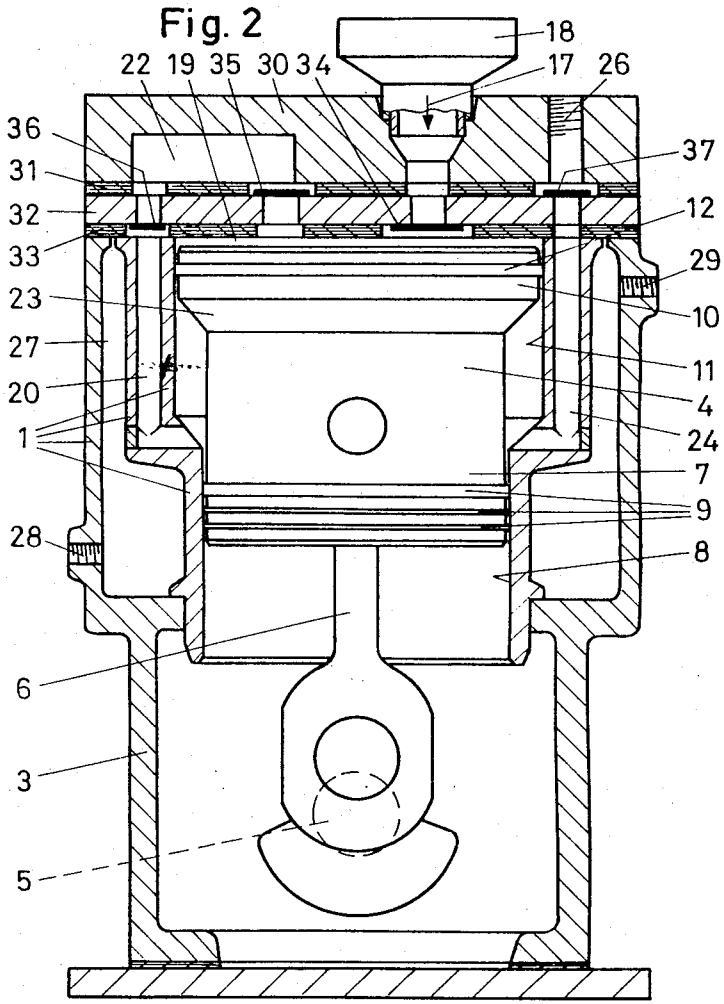
FIGS. 1 and 2 show two embodiments of an air compressor according to the invention each in schematic cross section.

The second embodiment according to FIG. 2 is water-cooled without cooling fins, having water-filled cooling chambers 27 in place thereof, which are supplied with coolant through the water entrance opening 28. The water discharge opening is designated by numeral 29.

The cylinder head arrangement consists of the actual cylinder head 30, a first seal 31, a valve plate 32 and a second seal 33. Four tongue valves 34–37 are disposed on the valve plate 32, whereby the seal 31 above the plate 32 and the seal 33 below the plate 32 again determine the valve strokes.

The remaining portions of the compressor are formed similar to the FIG. 1 embodiment, and are numerically designated accordingly.

The cylinder head combination 30–33 is screwed to the cylinder 1. The first compression chamber 19 is associated with inlet valve 34 and outlet valve 35, while the second compression chamber 21 is associated with inlet valve 36 and outlet valve 37. The air feed and discharge of the second stage is via the water-cooled tubes 20, 24, the volume of which must again be included in the dead volume of the second compression chamber 21.

As compared to known air compressors having stepped pistons, the above-described embodiments result in the following advantages:

All valves are arranged on the upper side of the compressor in the vicinity of the cylinder head. They are easily accessible for repair and maintenance costs are very low.

When all valves are disposed on a single plate (as in the second embodiment), they can easily be replaced during an inspection. Accordingly, the entire valve plate together with the valves can be replaced as a unit after removal of the cylinder head. This assures a substantial simplification of inspection and mounting.

The air compressor has fewer components than known compressors. The material costs are therefore lower and the procurement of replacement parts is facilitated.

As a result of the intensive cooling of the compression chamber of the second stage, the operating temperatures are relatively low and service life is high.

What is claimed is:

1. In an air compressor includng a cylinder having two portions of different diameter, a stepped piston reciprocatingly disposed in said cylinder to define low and high compression chambers in which said piston respectively performs compression in opposite stroke directions, a cylinder head closing the low compression chamber at one end of said cylinder, air inlet and outlet openings associated with each compression chamber, at least one inlet and one outlet valve associated with each compression chamber and the outlet opening of the low pressure chamber communicating with the inlet opening of the high pressure chamber, the improvement comprising: all of said inlet and outlet valves (14–16; 34–37) being disposed at said one end of said cylinder proximate said cylinder head to enable easy access to said valves for maintenance and repair by the removal of said cylinder head, further comprising a valve plate (32) disposed between said cylinder head and said cylinder (1), and wherein all said valves are disposed in said valve plate (FIG. 2).

2. A compressor according to claim 1, wherein the valves are formed as tongue valves, and further comprising seals (31, 33) disposed on both sides of said valve plate, the thickness of which seals determines the stroke of said valves.

3. In an air compressor includng a cylinder having two portions of different diameter, a stepped piston reciprocatingly disposed in said cylinder to define low and high compression chambers in which said piston respectively performs compression in opposite stroke directions, a cylinder head closing the low compression chamber at one end of said cylinder, air inlet and outlet openings associated with each compression chamber, at least one inlet and one outlet valve associated with each compression chamber and the outlet opening of the low pressure chamber communicating with the inlet opening of the high pressure chamber, the improvement comprising: all of said inlet and outlet valves (14–16; 34–37) being disposed at said one end of said cylinder proximate said cylinder head to enable easy access to said valves for maintenance and repair by the removal of said cylinder head, wherein said valves are disposed between said cylinder head (13) and said one end of said cylinder (1).

* * * * *